US009616441B2

(12) United States Patent
Hubmann et al.

(10) Patent No.: US 9,616,441 B2
(45) Date of Patent: Apr. 11, 2017

(54) MULTIPLE FUNCTION DISPENSER

(75) Inventors: Curtis H. Hubmann, Racine, WI (US); Robert C. Halstead, Enfield (GB); Matthew E. Young, Cambs (GB); Elizabeth A. Slater, Cambs (GB); Richard I. Simpson, Cambridge (GB); Reuben Wu, Saffron Walden (GB); John A. Boticki, Racine, WI (US)

(73) Assignee: Diversey, Inc., Sturtevant, WI (US)

( * ) Notice: Subject to any disclaimer, the term of this patent is extended or adjusted under 35 U.S.C. 154(b) by 697 days.

(21) Appl. No.: 13/619,800

(22) Filed: Sep. 14, 2012

(65) Prior Publication Data

US 2013/0126640 A1 May 23, 2013

Related U.S. Application Data

(60) Continuation of application No. 13/230,517, filed on Sep. 12, 2011, now Pat. No. 8,398,003, which is a (Continued)

(51) Int. Cl.
*A62C 5/02* (2006.01)
*B05B 7/12* (2006.01)
(Continued)

(52) U.S. Cl.
CPC ..... *B05B 7/12* (2013.01); *B01F 5/043* (2013.01); *B01F 5/0413* (2013.01); *B01F 5/0415* (2013.01); *B01F 5/0428* (2013.01); *B01F 13/002* (2013.01); *B01F 13/0027* (2013.01); *B05B 1/3013* (2013.01); *B05B 7/2443* (2013.01); *B01F 2005/044* (2013.01); *B01F 2005/0435* (2013.01)

(58) Field of Classification Search
USPC .... 239/318, 302, 310, 344, 353, 354, 581.1, 239/581.2, 569, 398
See application file for complete search history.

(56) References Cited

U.S. PATENT DOCUMENTS 1,202,425 A 10/1916 Randall
1,721,726 A 7/1929 Boe
(Continued)

FOREIGN PATENT DOCUMENTS

EP 1645335 4/2006
EP 1353756 6/2006
(Continued)

OTHER PUBLICATIONS

One page from a Johnson Wax Professional Brochure dated 2000 showing the J-Fill Portable Spray Unit.
(Continued)

*Primary Examiner* — David Hwu
(74) *Attorney, Agent, or Firm* — Michael Best & Friedrich LLP

(57) ABSTRACT

A dispenser for mixing and dispensing a liquid chemical concentrate with a dilutent from a container. The dispenser includes two slideable eductors one of which is also rotatable. Both a high and low flow rate can be obtained with simultaneous adjustment of concentration of the chemical concentrate. The dispenser has a high degree of accuracy of the amount of dilution of the chemical concentrate as well as positive positioning of the high and low flow rate.

15 Claims, 11 Drawing Sheets

Related U.S. Application Data continuation of application No. 12/024,851, filed on Feb. 1, 2008, now Pat. No. 8,016,212, which is a continuation of application No. 11/331,254, filed on Jan. 12, 2006, now Pat. No. 7,341,206, which is a continuation of application No. 10/758,884, filed on Jan. 16, 2004, now Pat. No. 7,025,289, which is a division of application No. 09/956,294, filed on Sep. 19, 2001, now Pat. No. 6,708,901.

(60) Provisional application No. 60/261,613, filed on Jan. 12, 2001.

(51) Int. Cl.

| | |
|---|---|
| ***B01F 5/04*** | (2006.01) |
| ***B01F 13/00*** | (2006.01) |
| ***B05B 1/30*** | (2006.01) |
| ***B05B 7/24*** | (2006.01) |

(56) References Cited

U.S. PATENT DOCUMENTS

| | | | |
|---|---|---|---|
| 2,389,134 | A | 11/1945 | Brown |
| 2,454,929 | A | 11/1948 | Kempton |
| 2,719,704 | A | 10/1955 | Anderson et al. |
| 2,781,061 | A | 2/1957 | Fey |
| 2,788,244 | A | 4/1957 | Gilmour |
| 2,991,939 | A | 7/1961 | Packard |
| 3,090,564 | A | 5/1963 | Gilmour |
| 3,145,735 | A | 8/1964 | Ossrow et al. |
| 3,228,613 | A | 1/1966 | Goldstein |
| 3,282,227 | A | 11/1966 | Nielsen |
| 3,357,598 | A | 12/1967 | Kraft |
| 3,473,481 | A | 10/1969 | Brane |
| 3,764,074 | A | 10/1973 | James |
| 3,776,468 | A | 12/1973 | Davenport |
| 3,847,178 | A | 11/1974 | Keppel |
| 3,862,640 | A | 1/1975 | Hechler, IV |
| 3,863,843 | A | 2/1975 | Hechler, IV |
| 3,938,550 | A | 2/1976 | Hechler, IV |
| 3,964,689 | A | 6/1976 | Horvath |
| 4,010,768 | A | 3/1977 | Hechler, IV |
| 4,014,363 | A | 3/1977 | Hechler, IV |
| 4,277,030 | A | 7/1981 | Hechler, IV |
| 4,382,552 | A | 5/1983 | Lubsen et al. |
| 4,422,833 | A | 12/1983 | Miller et al. |
| 4,475,689 | A | 10/1984 | Hauger et al. |
| 4,508,272 | A | 4/1985 | Thompson |
| 4,901,923 | A | 2/1990 | McRoskey et al. |
| 5,007,588 | A | 4/1991 | Chow et al. |
| 5,297,733 | A | 3/1994 | Burks et al. |
| 5,320,288 | A | 6/1994 | Ketcham, Jr. |
| 5,351,875 | A | 10/1994 | Rhine et al. |
| 5,372,310 | A | 12/1994 | Ketcham |
| 5,423,228 | A | 6/1995 | Budd et al. |
| 5,529,244 | A | 6/1996 | Horvath et al. |
| 5,544,810 | A | 8/1996 | Horvath, Jr. et al. |
| 5,765,605 | A | 6/1998 | Waymire et al. |
| 5,769,322 | A | 6/1998 | Smith |
| 5,927,338 | A | 7/1999 | Boticki et al. |
| 5,996,907 | A | 12/1999 | Toetschinger et al. |
| 6,079,595 | A | 6/2000 | Meyer et al. |
| 6,158,673 | A | 12/2000 | Toetschinger et al. |
| 6,161,779 | A | 12/2000 | Oyler et al. |
| 6,283,330 | B1 | 9/2001 | Gillespie et al. |
| 6,363,977 | B1 | 4/2002 | Smeller et al. |
| 6,425,534 | B2 | 7/2002 | Ketcham et al. |
| 6,655,401 | B2 | 12/2003 | Sand et al. |
| 6,708,901 | B2 | 3/2004 | Hubmann et al. |
| 6,749,133 | B1 | 6/2004 | Ketcham et al. |
| 6,765,605 | B1 | 7/2004 | Inoue |
| 6,772,914 | B2 | 8/2004 | Hubmann et al. |
| 6,988,675 | B2 | 1/2006 | Hubmann et al. |
| 7,025,289 | B2 | 4/2006 | Hubmann et al. |
| 7,341,206 | B2 | 3/2008 | Hubmann et al. |
| 7,370,813 | B2 | 5/2008 | Hubmann et al. |
| 7,850,095 | B2 | 12/2010 | Hubmann et al. |
| 8,016,212 | B2 | 9/2011 | Hubmann et al. |
| 2002/0008161 | A1 | 1/2002 | Ketcham et al. |
| 2002/0092925 | A1 | 7/2002 | Hubmann et al. |
| 2004/0155119 | A1 | 8/2004 | Hubmann et al. |
| 2008/0179420 | A1 | 7/2008 | Hubmann et al. |

FOREIGN PATENT DOCUMENTS

| | | |
|---|---|---|
| EP | 1716930 | 11/2006 |
| EP | 1675689 | 1/2007 |
| JP | 03/200174 | 7/2003 |
| JP | 2004/227309 | 8/2004 |
| TW | 515754 | 1/2003 |
| WO | 02/36267 | 5/2002 |
| WO | 02/055213 | 7/2002 |
| WO | 2005/023432 | 3/2005 |

OTHER PUBLICATIONS

Gilmour Group, "Spray Doc," catalog (1990) 6 pages, PA, USA.

One page from a Johnson Wax Professional Brochure (dated 2000) showing the J-Fill Portable Spray Unit.

A U.S. patent application entitled Spraying Apparatus with Insert. It is believed that this applicaton was filed in the USPTO some time after Aug. 11, 2000.

A U.S. patent application entitled Spraying Apparatus Having a Sealing Member with Apertures. This applicaton was filed in the USPTO Februarty 4, 1999, designated as U.S. Appl. No. 09/244,392 naming Ketcham as inventor.

Office Action from the US Patent and Trademark Office for Hechler, U.S. Appl. No. 13/619,777 dated Sep. 12, 2013 (5 pages).

Office Action from the US Patent and Trademark Office for U.S. Appl. No. 13/619,777 dated May 13, 2013 (6 pages).

Office Action from the US Patent and Trademark Office for U.S. Appl. No. 13/619,777 dated May 28, 2013 (6 pages).

MULTIPLE FUNCTION DISPENSER

CROSS-REFERENCE TO RELATED APPLICATIONS

This application is a Continuation of U.S. Ser. No. 13/230,517, filed on Sep. 12, 2011, which is a Continuation of U.S. Ser. No. 12/024,851, filed on Feb. 1, 2008 (now U.S. Pat. No. 8,016,212, issued on Sep. 13, 2011, which is a Continuation of U.S. Ser. No. 11/331,254, filed on Jan. 12, 2006 (now U.S. Pat. No. 7,341,206, issued on Mar. 11, 2008, which is a Continuation Application of U.S. Ser. No. 10/758,884 filed Jan. 16, 2004 (now U.S. Pat. No. 7,025,289, issued Apr. 11, 2006), which is a Divisional Application of U.S. Ser. No. 09/956,294, filed Sep. 19, 2001 (now U.S. Pat. No. 6,708,901, issued Mar. 23, 2004), which is a Utility Application based on Provisional Application 60/261,613, filed Jan. 12, 2001.

BACKGROUND OF THE INVENTION

The field of the invention is dispensers for chemical concentrates, and particularly the dispensing of chemical concentrates at multiple flow rates and different concentrations.

Dispensers of the type concerned with in this invention are disclosed in U.S. Pat. Nos. 5,320,288 and 5,372,310. While the spraying apparatus disclosed in these patents can control the flow of carrier fluid and chemical product, it cannot do so in a precise and controlled manner.

U.S. Pat. No. 2,719,704 discloses a valve element 31 with eductor passages 41 and 43. These interconnect with inlet openings 58 and 61.

U.S. Pat. Nos. 2,991,939 and 4,901,923 disclose eductor type dispensers having rotatable discs with various sized apertures for controlling the amount of concentrate being drawn into the water flowing through a nozzle.

A dispenser which dispenses chemical concentrate should have the capability of dispensing the concentration at a low rate such as in the instance where a bottle is to be filled and at a high rate where a bucket is to be filled. In the instance of a bucket fill, it is desirable if both a low and high concentration of chemical concentrate can be provided.

The prior art provides either a rotatable with concentrate flow passages, eductor type dispensers having rotatable discs with various sized apertures, or a sliding open-venturi. It does not provide a dispensing apparatus with both sliding and rotating eductors as well as valving so as to afford different concentrations of chemical concentrate at different flow rates.

SUMMARY OF THE INVENTION

The present invention provides a dispenser for dispensing different concentrations of chemical concentrate into a stream of water from a concentrate container at different flow rates. The dispenser includes a body member having a through bore with an inlet end adapted to be connected to a source of pressurized water at one end and an outlet at the opposite end connected to the inlet housing. A valve member is slideably positioned in the through bore of the body member. An eductor is slideably and rotatably received in the body member. The eductor is in contact with the valve member and in fluid communication with a source of chemical concentrate. A trigger member is connected to the body member and eductor to cause slideable movement of the eductor. The eductor and valve member are constructed and arranged to provide control of both different concentrations of chemical concentrate and different flow rates of water and chemical concentrate.

In a preferred embodiment, the eductor is composed of first and second parts with only the first part being rotatable and extending from the body member.

In another embodiment, a second part of the eductor is nonrotatable and includes a fluid passage. A dilution adjustment member having a multiplicity of different sized apertures is connected to the rotatable eductor for sealable engagement with the fluid passage.

In one aspect, the body member includes a product passage and a vent passage. A seal is constructed and arranged to seal both the product passage and the vent passage.

In another preferred embodiment, the valve member in the dispenser includes first and second valve members operatively associated with the nonrotatable eductor, the valve members constructed and arranged so that when the first valve member is moved in a linear slideable manner with respect to the second valve member, a first flow rate is effected and when the second valve member is moved in a linear slideable manner with respect to the body portion with the first valve member moved linearly with respect to the second valve member, a second faster flow rate is established.

In another aspect, the dispenser includes an elongated spout connected to the body member and a flexible tube member connected to the eductor and the spout.

In yet another aspect, the trigger member includes a latching mechanism.

In still another aspect, the body of the dispenser includes a finger engaging portion extending therefrom at the inlet and a trigger member pivotally connected to the body and extending over a portion of the body opposite the finger engaging portion.

In yet another preferred embodiment, there are indexing members operatively associated with the body member and the eductor.

A general object of the invention is to provide a dispensing apparatus which can effect a mixing of chemical concentrate into a stream of water at different concentrations and dispense the mixed concentrate at controlled flow rates.

Another object is a closed dispenser which produces low foam, low air entrapment and a low energy liquid fill independent of the pressure of the attached water supply Other general objectives are a dispensing apparatus which can both spray and/or fill, gives control over both flow and dilution and lends itself to be integrated with a bottle so they cannot be separated.

Still another object is a dispenser which is composed of plastic parts, thus economical to produce and is disposable.

Yet another object is a dispenser of the foregoing type which has a good hand feel.

Still yet another object is a dispenser of the foregoing type which can accurately dispense chemical concentrate.

Yet another object is a dispenser of the foregoing type which can accommodate a back flow prevention device.

DESCRIPTION OF THE PREFERRED EMBODIMENTS

Figure 1:
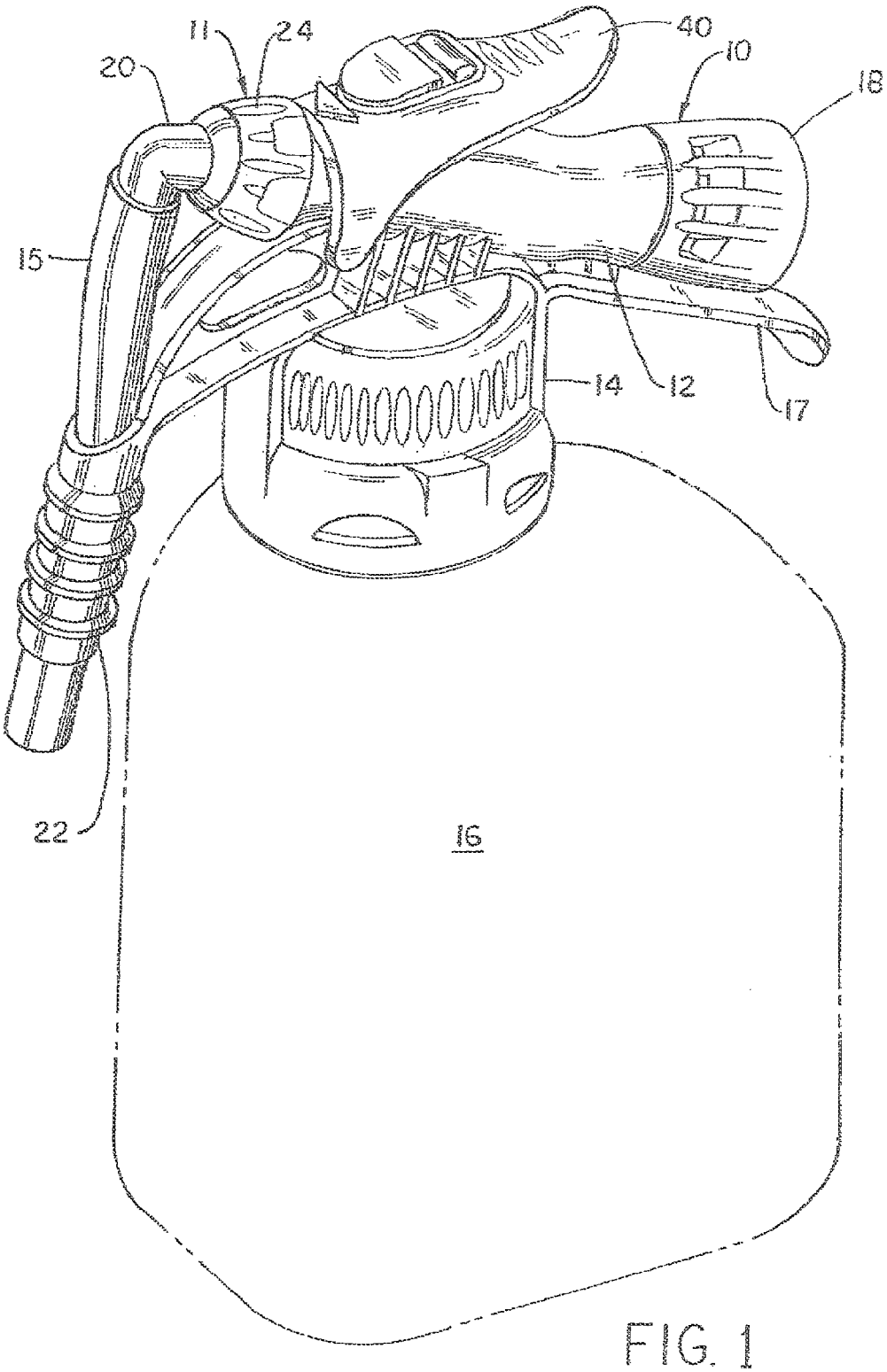
FIG. 1 is a perspective view of the dispenser of this invention in conjunction with a container.
Figure 2:
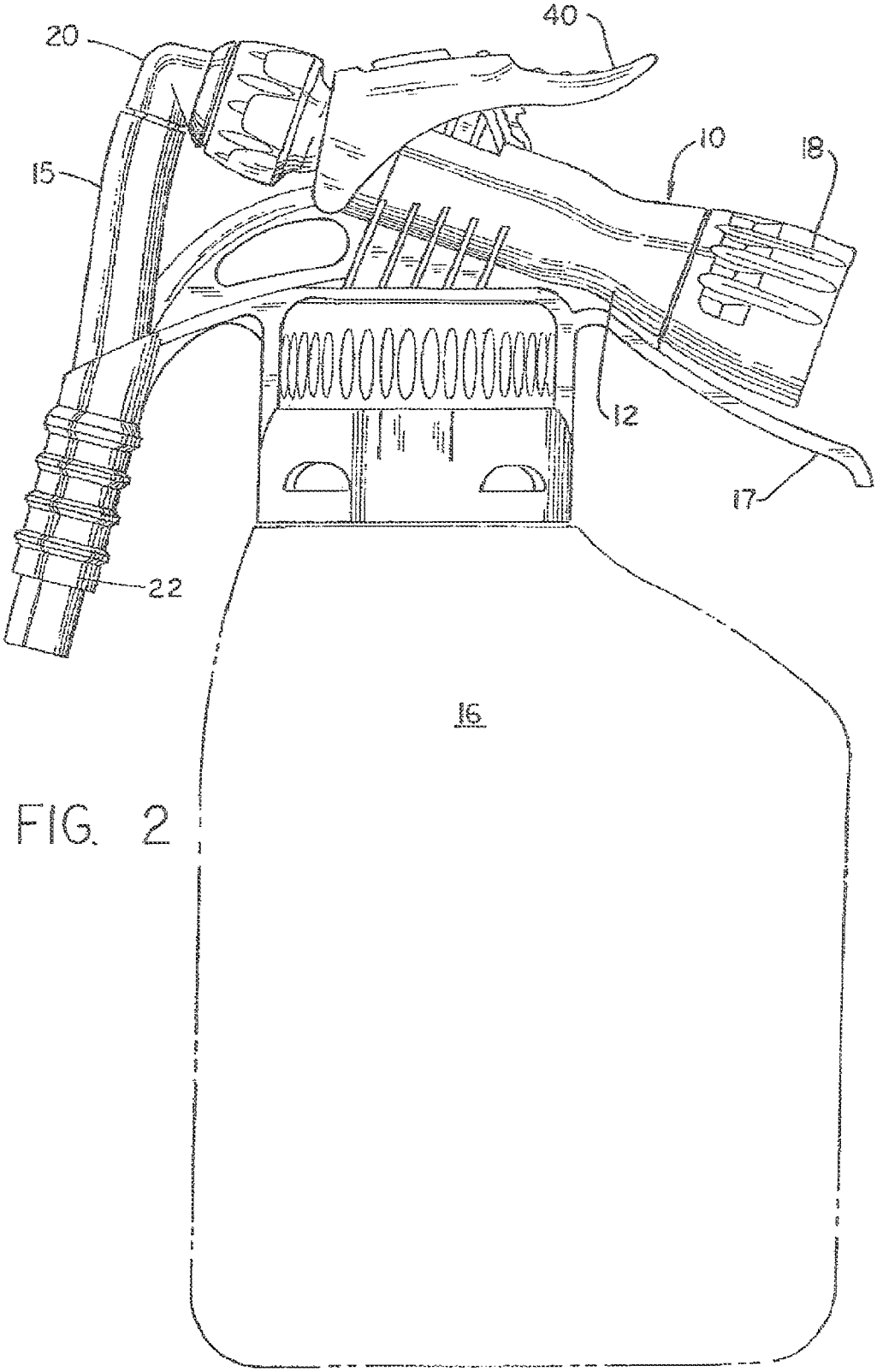
FIG. 2 is a view in side elevation of the dispenser shown in FIG. 1.

Referring to FIGS. 1 and 2, the dispenser generally 10 has a body member 12 with a container connector 14 for connection to a container or bottle 16. A preferred connector system is more fully described in commonly owned U.S. Pat. No. 6,772,914 issued Aug. 10, 2004, which teachings are incorporated herein. At one end of the body member 12 is a hose attachment 18 for supplying pressurized water to the dispenser. A handle 17 is provided below attachment 18. At the other end there is the spout 22 and a nozzle 20 for dispensing a mixed chemical solution. A flexible tube 15 extends between nozzle 20 and spout 22.

Figure 3:
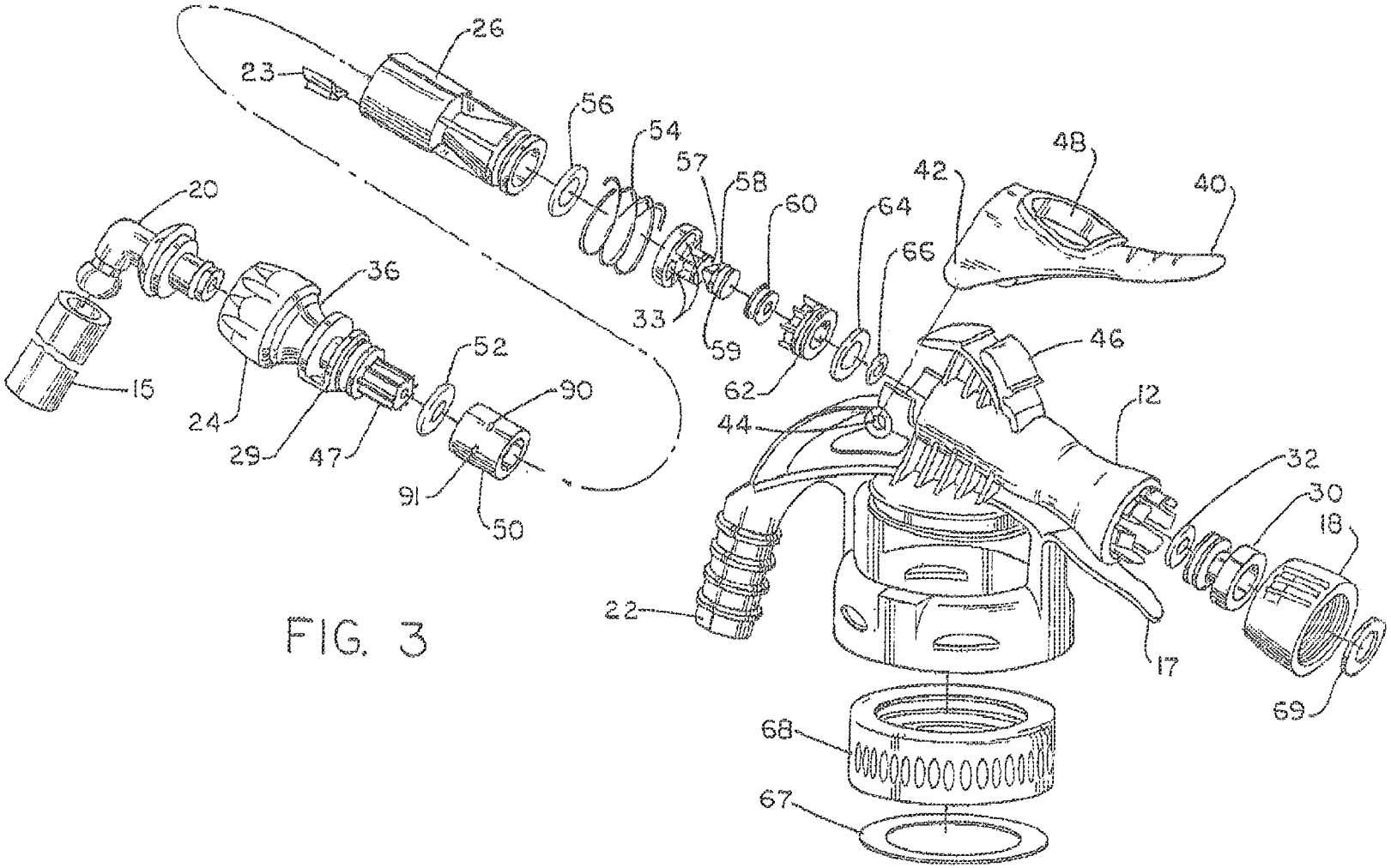
FIG. 3 is an exploded view of the component parts of the dispenser.
Figure 4:
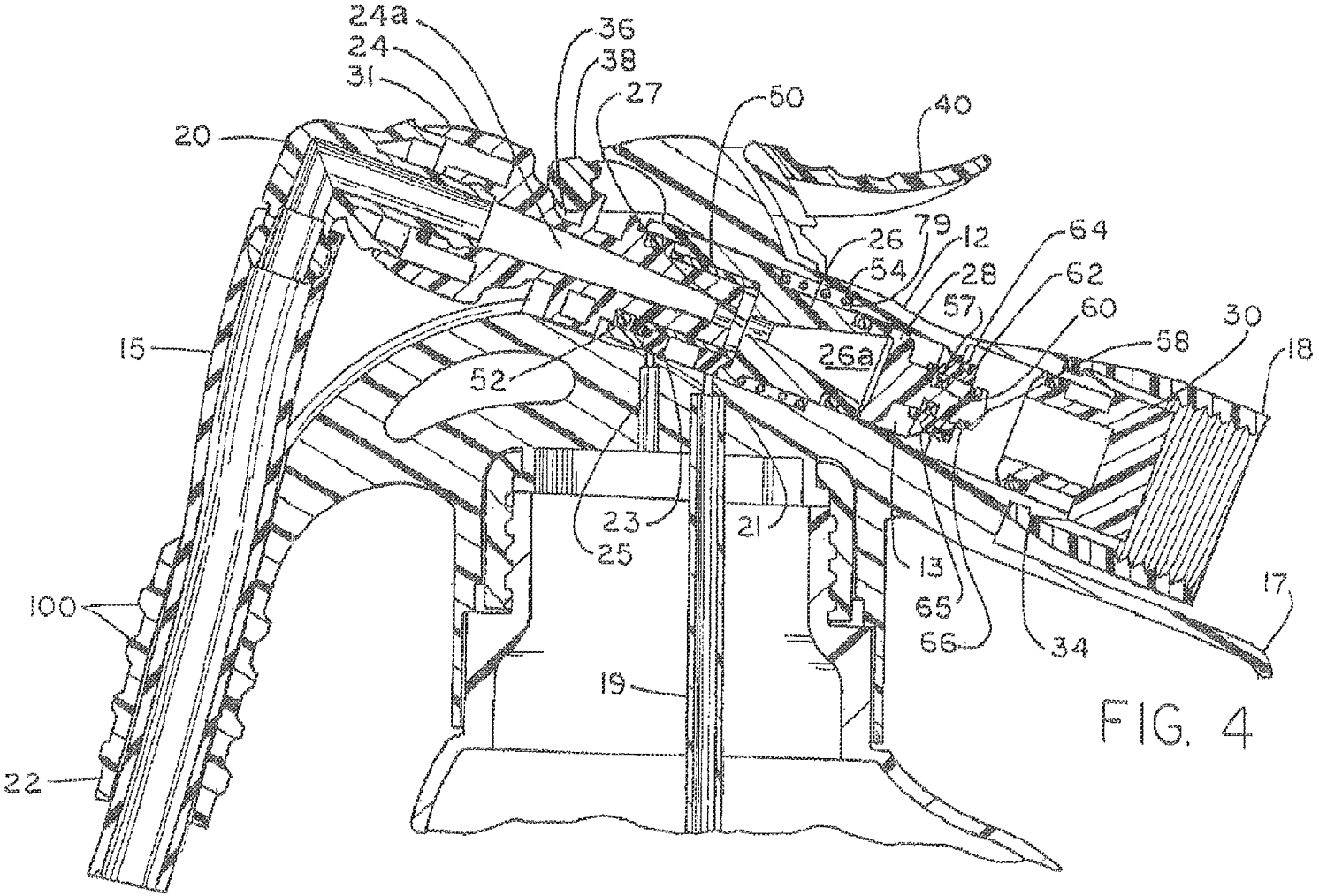
FIG. 4 is a cross sectional view of the dispenser in a closed position.

Referring to FIGS. 3 and 4, the dispenser 10 includes an eductor generally 11 composed of the first or outer eductor part 24 with a diverging passage 24*a* and an inner second eductor part 26 with a converging passage 26*a*. They are slideably connected in body member 12 with seals 52 and 56 providing a fluid tight contact. A valve assembly 28 for controlling the flow of water through the dispenser 10 is also slideably housed in body member 12 and is in contact with eductor part 26. The hose attachment 18 is rotatably connected to body member 12 by the snap fitment 34. A back flow preventer 30 is positioned in hose attachment 18 and has a seal 32 for contact with body member 12. At the opposite end of body member 12, the nozzle 20 is attached to eductor part 24.

An annular groove 36 is provided in the eductor part 24 and accommodates a head portion 38 of the trigger 40 with flange portions such as shown at 42 on the trigger 40 having shafts (not shown) for extending into bores such as 44. A latch member 46 extends upwardly from the member 12 for fitment through the passage 48 of the trigger 40.

Figure 9:
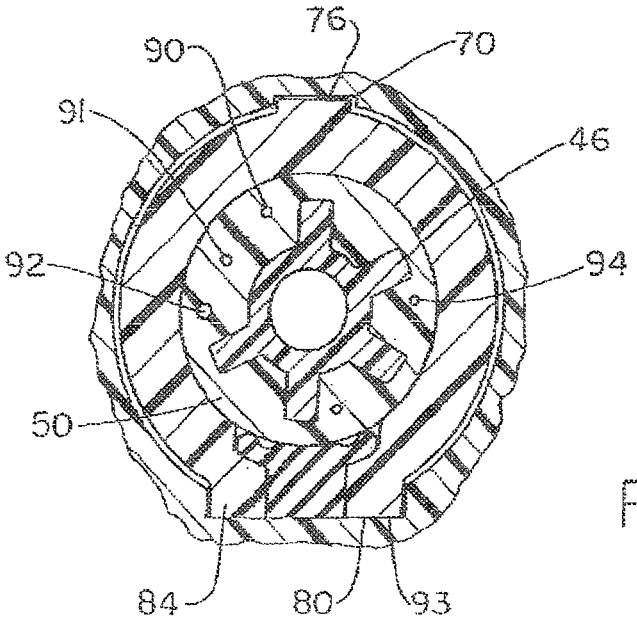
FIG. 9 is a cross sectional view of the dilution adjustment member utilized in the dispenser.
Figure 11:
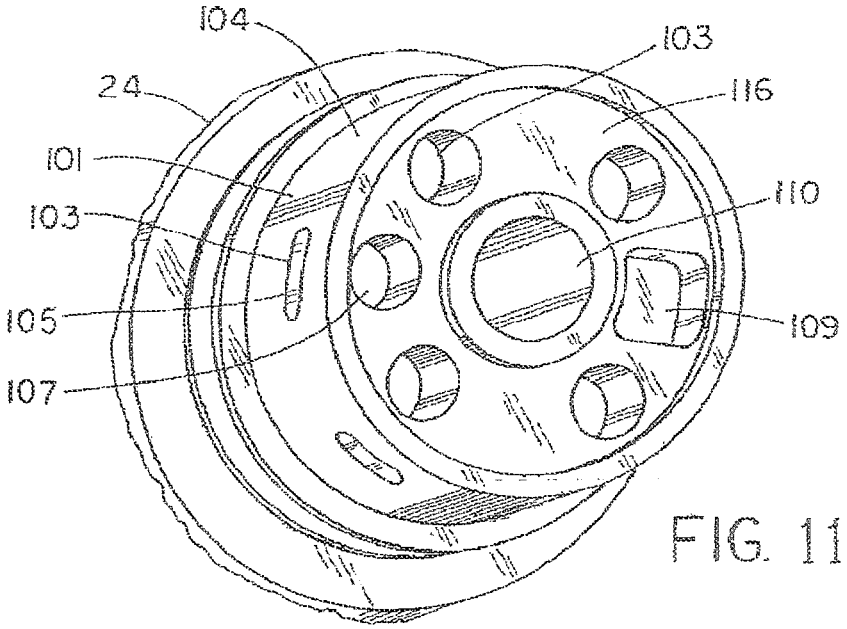
FIG. 11 is a perspective view of the housing of the dilution adjustment member shown in FIG. 10.

A dilution adjustment member 50 is connected to the eductor part 24 by means of the splines 47. This is shown in FIG. 9. It has L-shaped passages 90-94 for introducing chemical concentrate into the gap 27 between eductor parts 24 and 26. These passages 90-94 have different diameters or widths for metering different concentrations of chemical concentrate. In some instances there are no passages to provide a rinse function. A dip tube 19 is connected to body member 12 and extends into container 16 for siphoning chemical concentrate into the bore 13 of body member 12 by way of passage 21. A seal member 23 is placed between dilution adjustment member 50 and body member 12. A vent passage 25 connects container 16 and bore 13. The adjustment member 50 is positioned inside eductor 26. A spring 54 biases eductor part 26 as well as eductor part 24 toward the head portion 38 of trigger 40.

A quad O-ring 60 is attached in groove 57 of valve head portion 58. It serves as a flow control element as later explained. A valve member 28 with passages 33 has a head portion 58 with groove 59. A seal 66 is seated in groove 59 of head portion 58 and another seal 64 is placed on collar 62. A gasket 67 is provided for cap 68 and a hose seal is provided at 69.

Figure 8:
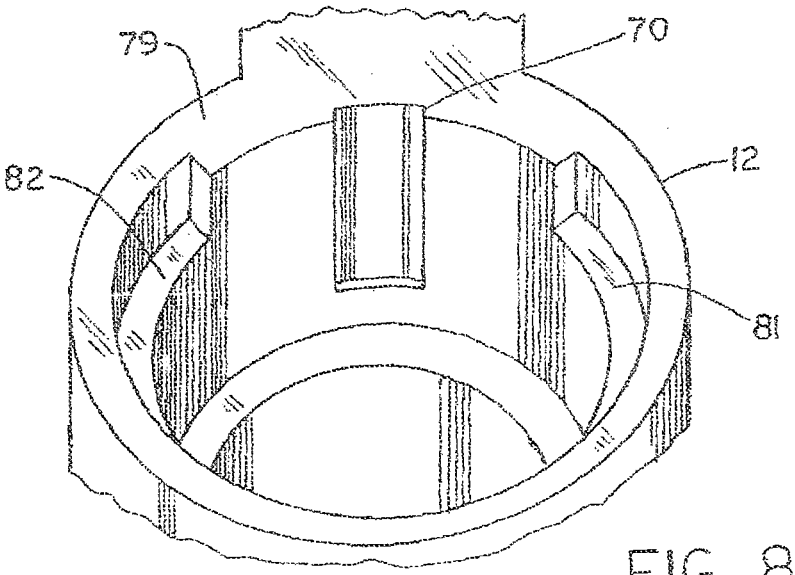
FIG. 8 is a fragmentary view of the dispenser housing illustrating the eductor contact surfaces for limiting the movement thereof.
Figure 15:
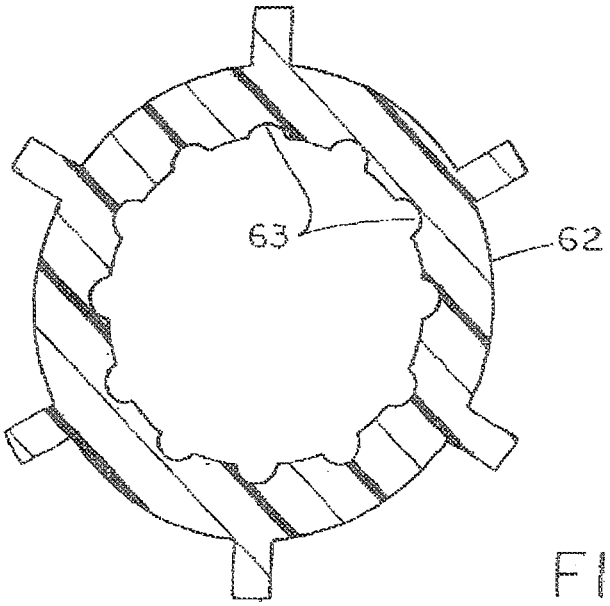
FIG. 15 is a cross sectional view of a component of a flow control device employed in the dispenser.

Referring to FIG. 8, it is seen that body member 12 has a surface 79 for contact with contact member 29 of eductor 24 as well as a grooves 81 and 82 for the purpose of linearly positioning the eductors 24 and 26 and accordingly valve assembly when trigger 40 is depressed. A keyway 70 is disposed in body member 12 for accommodating a key member 76 (See FIG. 9) in eductor part 26 for allowing sliding but nonrotatable connection in body member 12. A second opposing keyway 80 is also disposed in body member 12 in conjunction with key member 84.

Figure 7:
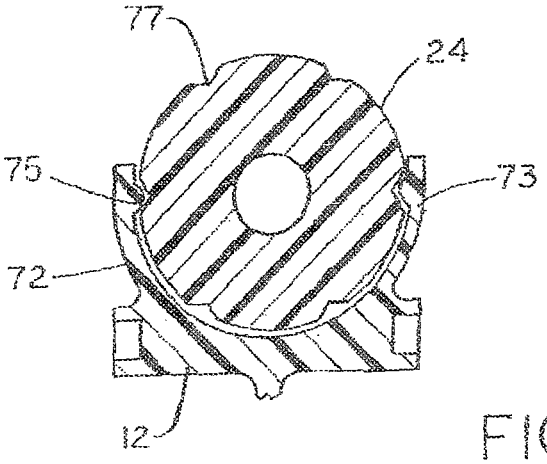
FIG. 7 is a cross sectional view illustrating an indexing of an eductor in the dispenser.

Referring to FIG. 7, there is shown the eductor 24 with notches 77. These accommodate the projections 75 on arms 72 and 73 extending from body member 12. This provides an indexing function in conjunction with the orientation of dilution adjustment member 50 and passage 21.

Figure 13:
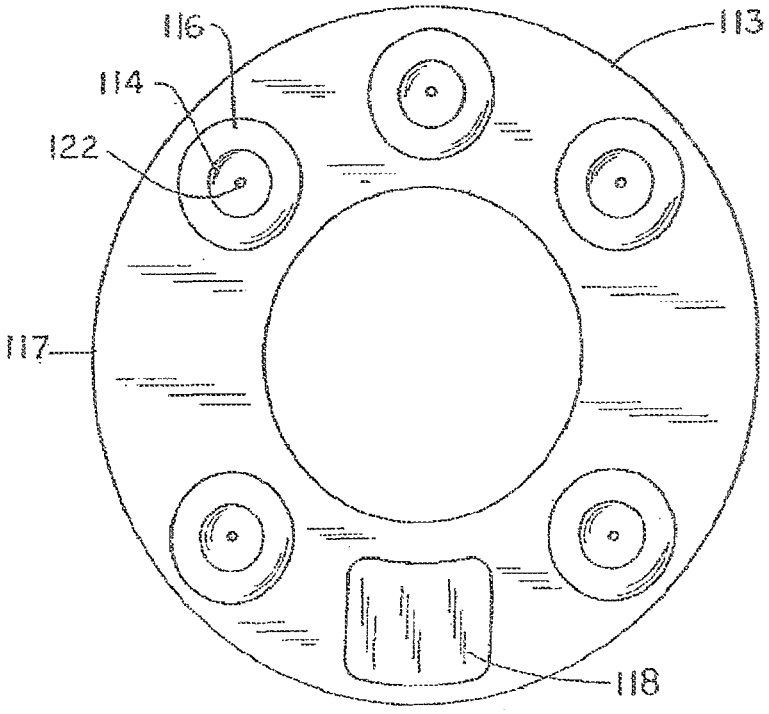
FIG. 13 is a back view of the dilution adjustment device shown in FIG. 12.
Figure 14:
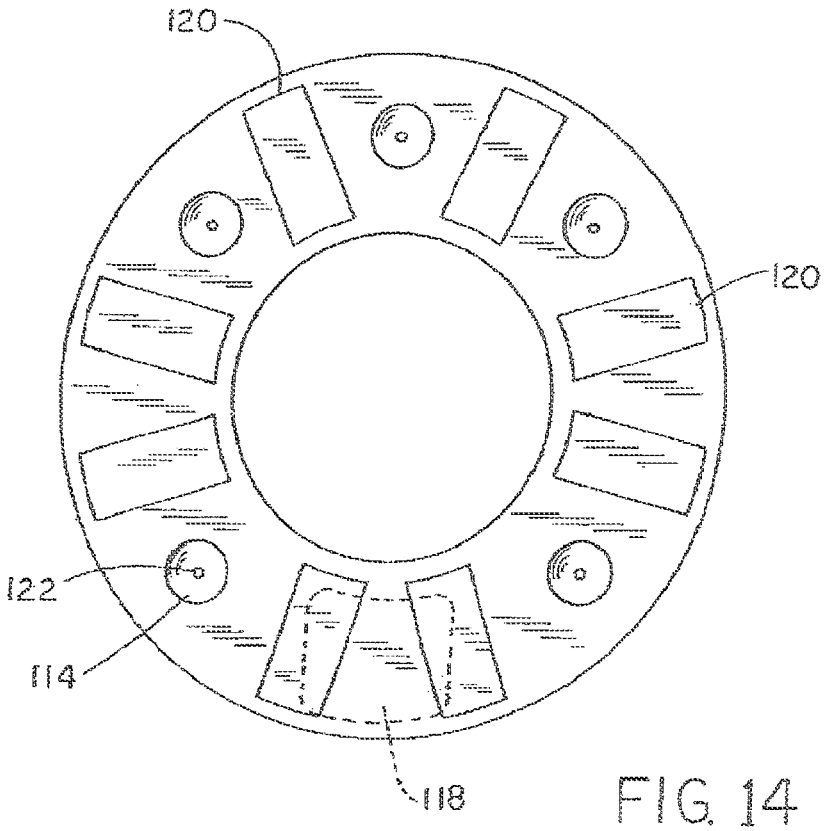
FIG. 14 is a front view of the dilution adjustment device shown in FIG. 12.

FIGS. 10-14 illustrate an alternative embodiment of the dilution adjustment member 50 which is formed as a separate component from the eductor 24. In the embodiment, generally 101 shown in these FIGURES, the dilution adjustment member includes a dilution adjustment housing 102 into which is fitted a dilution adjustment device 112. Housing 102 includes a central passageway 110 for flow of water and chemical concentrate. It also has five L-shaped passages 103 with an oval portion 105 in a side wall 104 and a cylindrical portion 107 in an end wall 106. The annular adjustment device 112 frictionally fits inside annular housing 102 and also has a central passageway 111 for water and chemical concentrate. As best seen in FIG. 13, adjustment device or adapter 112 has an annular body 113 through which extend the passages 114 from a front side 115 to a back side 117. These passages also extend through tubular members 116 at the back side 117. These tubular members 116 fit into the cylindrical portions 107 of passages 103 in dilution adjustment housing 102. Passages 114 have constrictive bores 122 which are of various dimensions. Alternatively one or more of them could be blocked to provide a rinse function. An orientation projection 118 extends from back side 117 for fitment into orientation compartment 109 of adjustment housing 102. This facilitates orientation of the tubular members 116 into portions 107. Projections 120 extend from front side 115 for contact with eductor 26 to provide the gap 27 between the eductors.

Operation

A better understanding of the dispenser will be had by a description of its operation. Referring to FIG. 4, the dispenser is shown in a closed position. A source of pressurized water such as a hose will have been connected to hose attachment 18. In this instance, seal 66 on valve head 58 is seated against collar 62 and seal 64 against valve seat portion 65. Accordingly, no water can pass between these two components and into bore 13. This sealing effect is assisted by the flow of water in through the attachment 18, against the valve components 58 and 62. The spring 54 and force of water also positions the head 31 of eductor part 24 away from body contact surface 79.

Figure 5:
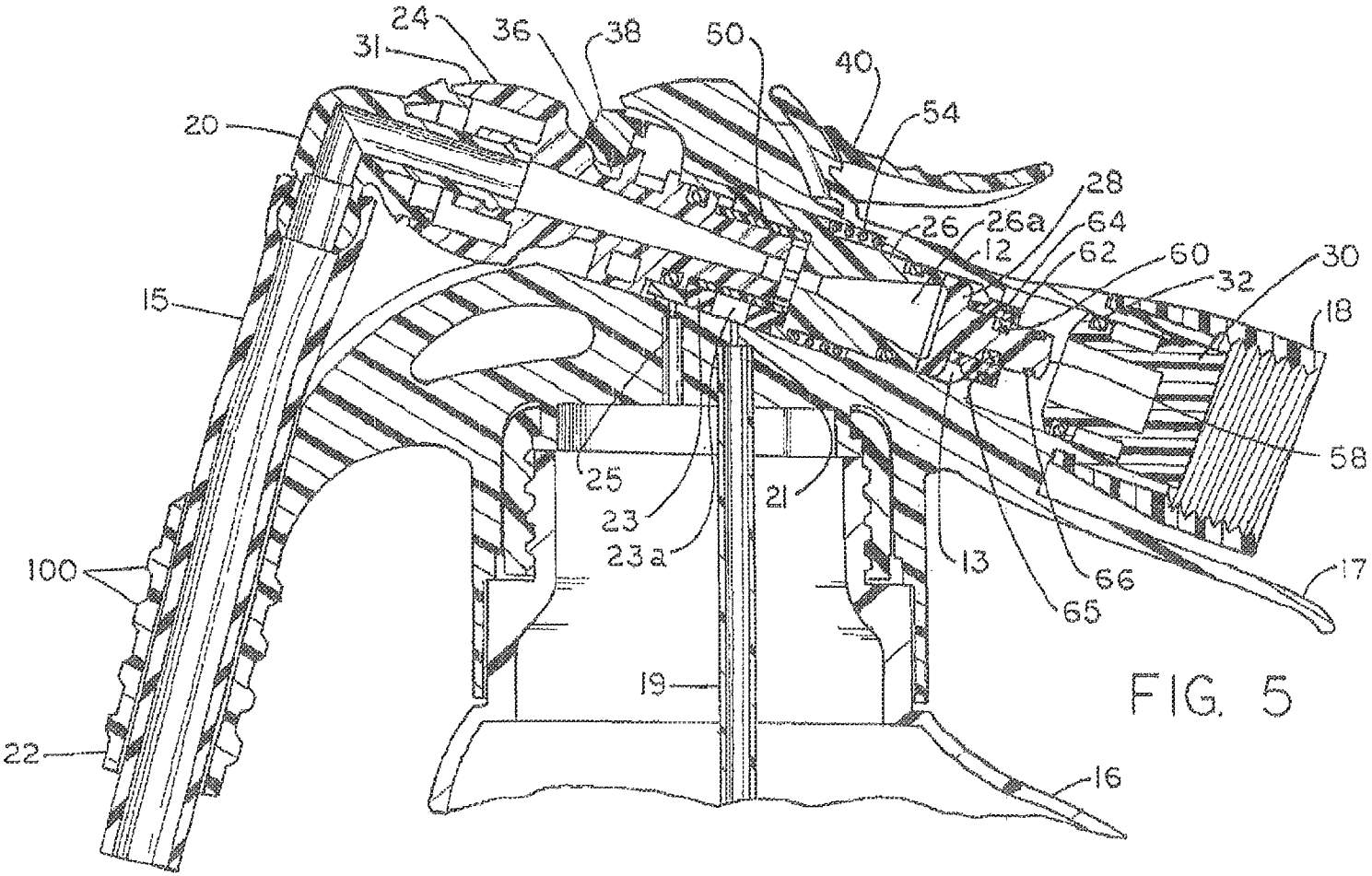
FIG. 5 is a view similar to FIG. 4 showing the dispenser in a low flow condition.

Referring now to FIG. 5, trigger 40 has been moved toward body member 12 with the result that eductor head 31 is contacting surface 79 of body member 12. Valve portion 58 has moved toward the attachment 18 and seal 66 no longer engages collar 62. In this position, water can flow between the two component parts as there are grooves 63 placed in the collar 62 to allow such flow into bore 13. This is a low flow condition. In this position, the quad O-ring 60 serves as a flow control element, in that, with increased pressure and flow of water, the ring will expand and partially fill the grooves 63. This maintains a consistent flow rate despite variations in the pressure of the inlet water supply. Water can then pass through passages 33 and into passage 26*a* of eductor part 26.

Figure 6:
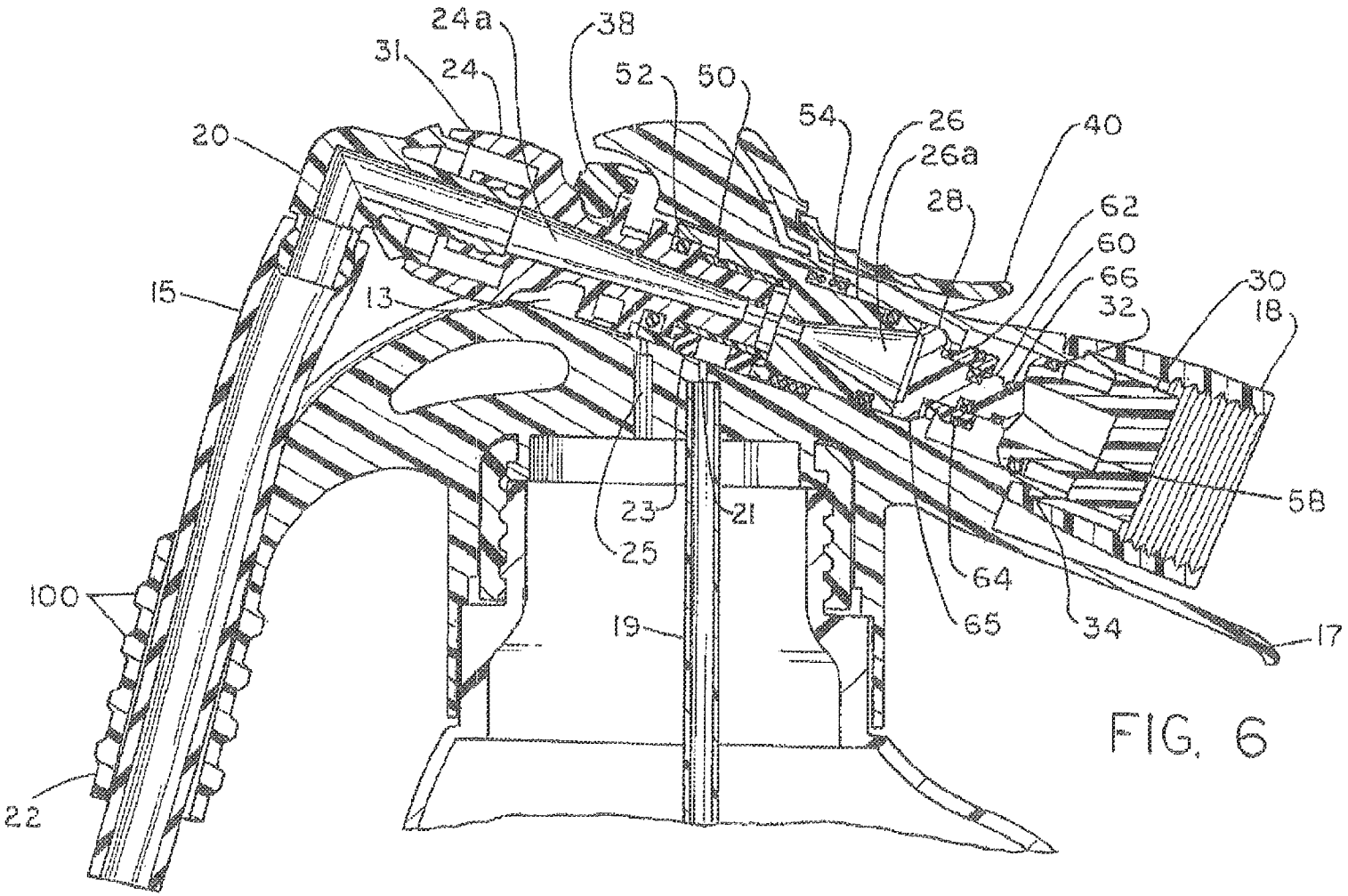
FIG. 6 is a view similar to FIG. 4 showing the dispenser in a high flow condition.

In order to initiate a high flow condition, the trigger 40 is moved further toward body member 12. This is shown in FIG. 6. In this position, not only has seal 66 moved away from collar 62 but collar 62 also has moved away from valve seat portion 65. In this position, water cannot only flow from between head portion 58 and the grooves 63 in the collar 62, but also between the collar 62 and the valve seat portion 65. It should be pointed out that in this high flow position, trigger 40 can now become engaged with latch 46 if desired so that it can be held in the high flow condition. Referring again to FIG. 8, the contact member 29 of eductor part 24 will now engage the grooves such as 81 or 82 so as to allow the eductor parts 26 and 24 to be moved further inwardly into the body 12.

Figure 10:
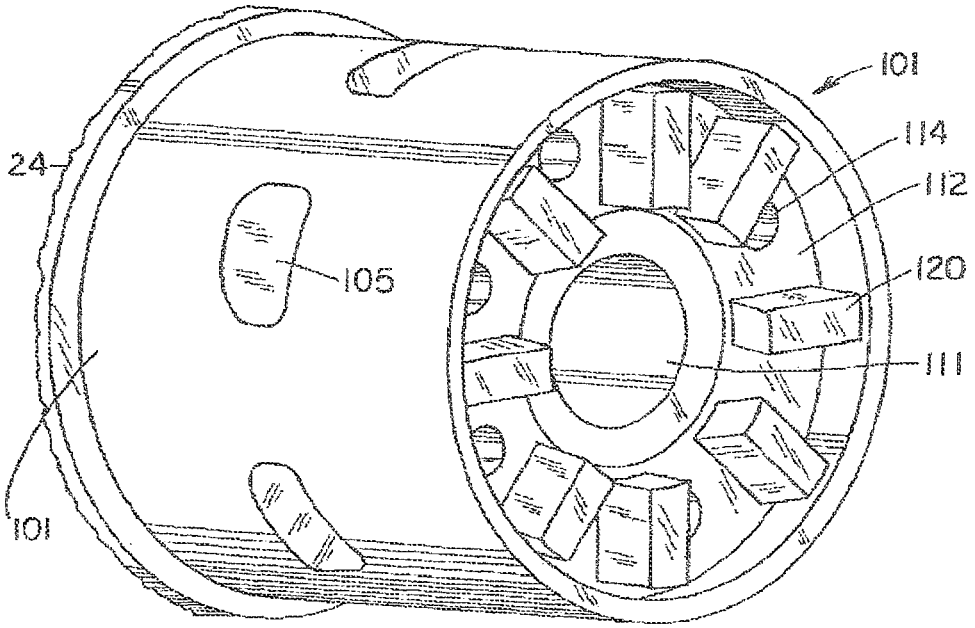
FIG. 10 is a perspective view of an alternative dilution adjustment member in the dispenser.
Figure 12:
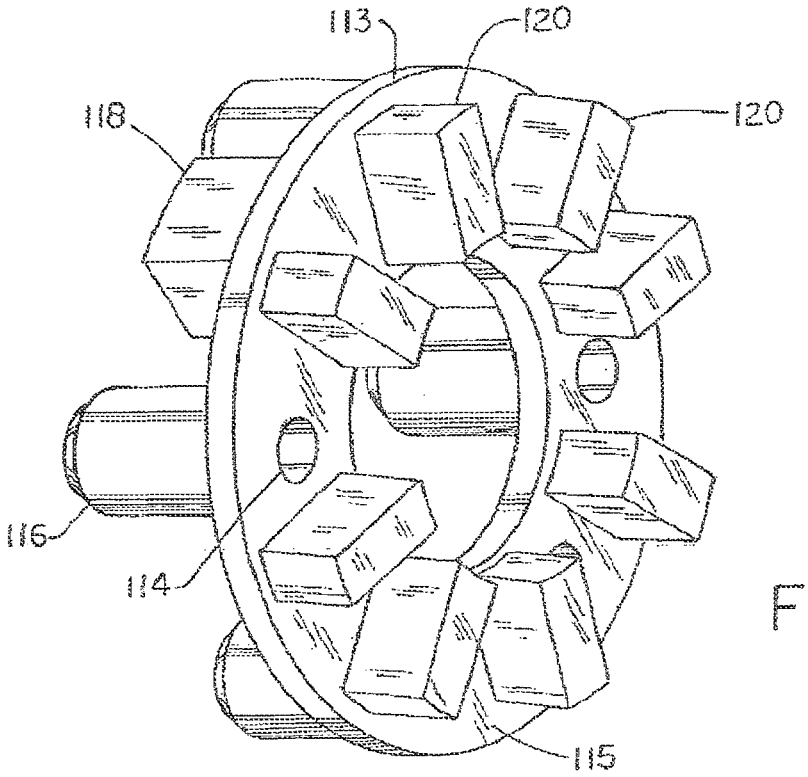
FIG. 12 is a perspective view of a dilution adjustment device for use in the dilution adjustment member.

During the previously described flow conditions through the dispenser 10 such as when in the high or low flow condition, the concentrate will be drawn upwardly from the container 16 such as through the dip tube 19. However, as noted previously in FIG. 4, there is a seal member 23 positioned over the passage 21 so that no product can be drawn up from the container 16. At the same time, seal 23 also closes vent passage 25. As seen in both FIGS. 5 and 6, the seal member 23 has moved away from both the product and vent passages 21 and 25, respectively. In this position, drawn product is allowed to enter into one of the five passages 90, 91, 92, 93 and 94 of dilution adjustment member 50 as seen in FIG. 10. Concentrate is thereby siphoned into gap 27 and mixed with water flowing through passage 26*a* and 24*a*. A reduced pressure is caused by the water converging in passage 26*a* and diverging in passage 24*a*.

The orientation of the various passages 90-94 with the opening 23*a* in seal 23 is facilitated by the indexing shown in FIG. 7.

The mixed solution will then exit through nozzle 20 down through the tube 15 positioned in the spout 22. Tube 15 in this instance is flexible so as to allow the eductor 24 to move inwardly and outwardly from the body member 12. With product passing through tube 15 and spout 22, this is the position which is utilized when filling a bucket or a bottle. As previously described a low flow condition would be utilized for filling a bottle while the high flow condition would be utilized to fill a large vessel such as a bucket. The spout 22 provides for the dispenser to be hung on a bucket 22*a*. If desired, a hose (not shown) can be connected to spout 22 for filling purposes such as a "scrubber washer" or when the dispenser is mounted to a wall. Dispenser 10 can easily be converted to a spray unit by the replacement of the nozzle 20 and the attachment of a conventional spray head (not shown). Also stated previously, the concentration of the solution can be easily adjusted by the rotation of the eductor 24 in conjunction with the dilution adjustment member 50. The low and high flow condition in combination with the dilution adjustment member obviates the use of multiple dispenser heads.

It will thus be seen that there is now provided a very versatile dispenser which can be utilized in not only a high and a low flow condition but also can be adjusted to vary the concentration of mixed solution. The dispenser 10 is produced economically so that once it is captively connected to a container, it is disposable.

It will also be seen that a good hand feel is provided by dispenser 10. This is accomplished by placement of the handle 17 beneath body member 12 and outwardly from trigger 40 to allow placement of a thumb on trigger 40.

Dilution adjustment member 101 will function in the same manner as dilution adjustment member 50. The advantage it has is that the formation of the passages 114 in dilution adjustment device 112 can be more easily controlled as a separate piece during plastic molding. Further, it is less expensive to supply several dilution adjustment devices 112 with varying dimensions of the passages 114 for fitment into housing 102. To facilitate identification they can be of different colors.

The dispenser 10 has been preferably described in conjunction with a latching feature for the trigger 40. It is obvious that this is not an essential feature that can be eliminated. Neither is it essential that a back flow preventer be employed in the unit itself. This could be accomplished upstream in a supply line. Further, while the spout 22 offers the advantage of a hose attachment such as with the barbs 100, this could be eliminated although it does further offer the advantage of a bucket attachment. Neither is it essential that the container connector 14 provides a captive use of the dispenser with the container. The dispenser 10 could be utilized with a refillable container. While dilution adjustment members 50 and 101 have been shown to have five passages, the number can vary from a single passage to as many as can be practically manufactured. In some instances, it may be desirable to limit the dispenser for flow through a single passageway. This could be accomplished by placement of a pin through body member 12 and a groove in eductor part 24. All such and other modifications within the spirit of the invention are meant to be within a scope as defined by the appended claims.

What is claimed is:

1. A dispenser for dispensing different concentrations of chemical concentrate into a stream of water from a concentrate container at different flow rates comprising:

a body member having a through bore with an inlet end adapted to be connected to a source of pressurized water at one end and an outlet at the opposite end connected to the inlet end; and an eductor at least partially disposed in the bore, the eductor being in fluid communication with a source of chemical concentrate and including a plurality of spaced apertures through which chemical concentrate flows, the eductor movable to different positions relative to the body member to provide control of both different concentrations of chemical concentrate and different flow rates of water and chemical concentrate to the outlet.

2. The dispenser of claim 1 wherein the eductor is composed of first and second parts, only one of which is rotatable.

3. The dispenser of claim 2 wherein the first part of the eductor is rotatable and extends from the body member.

4. The dispenser of claim 3 wherein the second part is nonrotatable, and the first and second parts of the eductor provide a fluid passage.

5. The dispenser of claim 4 further including a dilution adjustment member disposed on the first part, wherein the plurality of spaced apertures are circumferentially spaced on the dilution adjustment member for fluid communication with the fluid passage.

6. The dispenser of claim 5 further including a product passage and a vent passage in the body member and a seal constructed and arranged to seal both the product passage and the vent passage.

7. The dispenser of claim 5 wherein the dilution adjustment member includes a multiplicity of different sized passages.

8. The dispenser of claim 5 wherein the dilution adjustment member includes non-linear passages selectively connecting the plurality of apertures with the fluid passage.

9. The dispenser of claim 8 wherein the eductor includes first and second parts and a gap between the first and second parts, and wherein the passages are in communication with the gap.

10. The dispenser of claim 1 further including a valve assembly disposed upstream of the eductor, the valve assembly including a valve member having a plurality of passages to direct a flow of water to the eductor.

11. The dispenser of claim 10 wherein the valve member includes a first groove and a second groove, and wherein a flow control element is disposed in the first groove.

12. The dispenser of claim 11 wherein a seal is disposed in the second groove.

13. A dispenser for dispensing different concentrations of chemical concentrate into a stream of water from a concentrate container at different flow rates comprising:

a body member having a through bore with an inlet end adapted to be connected to a source of pressurized water at one end and an outlet at the opposite end connected to the inlet end;

an eductor at least partially disposed within the bore and defining a fluid passage, the eductor movable to different positions relative to the body member to provide control of different flow rates of water and chemical concentrate from the fluid passage to the outlet;

a product passage connected between the container and the body member to selectively provide chemical concentrate to the fluid passage;

a vent passage connected between the container and the bore; and a seal constructed and arranged to selectively seal both the product passage and the vent passage when the eductor is moved.

14. The dispenser of claim 13 wherein the seal is movable with the eductor to expose the product passage and the vent passage when the eductor is moved from a first, non-dispensing position to a second, dispensing position.

15. The dispenser of claim 13, further including a dilution adjustment member disposed on the eductor, and wherein the seal is disposed between the dilution adjustment member and the body member within the bore.

* * * * *